US005816674A

United States Patent [19]

Manos et al.

[11] Patent Number: 5,816,674

[45] Date of Patent: Oct. 6, 1998

[54] STACKABLE CONTAINER ASSEMBLY

[75] Inventors: Joseph D. Manos, Spencer; Rino Conti, Stoughton, both of Mass.

[73] Assignee: Holiday Housewares, Inc., Leominster, Mass.

[21] Appl. No.: 732,997

[22] Filed: Oct. 16, 1996

[51] Int. Cl.[6] ..... A47B 81/00

[52] U.S. Cl. ..... 312/290; 312/108; 312/330.1; D9/425

[58] Field of Search ..... 312/290, 283, 312/286, 107, 108, 111, 330.1, 350, 293.1, 293.3, 310; 220/4.26, 4.27, 4.28, 503, 601, 661; D9/423, 424, 425

[56] References Cited

U.S. PATENT DOCUMENTS

| | | | |
|---|---|---|---|
| D. 330,161 | 10/1992 | Schuh | D9/423 |
| D. 356,256 | 3/1995 | Romanoff | D9/425 |
| D. 373,953 | 9/1996 | Gale | D9/425 |
| 2,739,026 | 3/1956 | Moore | 312/286 X |
| 2,929,228 | 3/1960 | Gould, Jr. | 312/108 X |
| 2,988,412 | 6/1961 | Vannice | 312/111 |
| 3,028,207 | 4/1962 | Darnell | 312/111 |
| 3,030,163 | 4/1962 | Gottsegen | 312/111 |
| 3,655,065 | 4/1972 | Yellin | 312/107 X |
| 3,758,181 | 9/1973 | Bolyos | 312/107 |
| 3,918,781 | 11/1975 | Paris | 312/330.1 X |
| 4,653,818 | 3/1987 | De Bruyn | 312/350 X |
| 4,863,056 | 9/1989 | Inayama | 220/4.28 X |
| 5,259,668 | 11/1993 | Teufel et al. | 312/286 X |
| 5,466,058 | 11/1995 | Chan | 312/107 X |
| 5,588,727 | 12/1996 | D'Aggro et al. | 312/330.1 X |
| 5,603,559 | 2/1997 | Yemini | 312/334.44 X |

*Primary Examiner*—Peter M. Cuomo
*Assistant Examiner*—James O. Hansen
*Attorney, Agent, or Firm*—Pandiscio & Pandiscio

[57] ABSTRACT

A container assembly includes a housing having open first and second opposite ends and an open top, a drawer in the form of a tote movable into and out of the housing, said drawer having an open top end, and a cover adapted to be releasably attached to said housing in covering relation to the open top of said housing. The cover and drawer also may be adapted to permit the cover to be releasably attached to the drawer so as to cover the open top end of the drawer. Each container assembly is configured so as to permit stacking a plurality thereof, with the bottom of one housing resting on the cover of a lower container assembly.

8 Claims, 6 Drawing Sheets

STACKABLE CONTAINER ASSEMBLY

BACKGROUND OF THE INVENTION

1. Field of the Invention

The invention relates to "tote"-type containers and more particularly to tote-type containers which are readily stackable and thereafter selectively usable without disturbing the stack.

2. Description of the Prior Art

Containers commonly referred to as "tote" type containers ("totes") generally are made of plastic and comprise a container having a bottom wall, side and end walls upstanding from the bottom wall, an open top, and hand grip portions whereby the container can be lifted and carried. The upper ends of the side and end walls are adapted to make a releasable connection with a cover for closing off the otherwise open top. Such "totes" have become popular and are widely used for a host of storage purposes e.g., holding clothing or other articles.

The totes with their covers in place also offer the advantage that they can be stacked one upon the other. However, when used in such manner, to gain entry to the contents of any tote beneath the uppermost tote, the totes above the wanted tote must be removed and placed at a location removed from the stack and subsequently they must be returned to the stack. If it is desired to maintain the stack in a desired order, the disassembly and re-assembly of the stack must be conducted so as to assure that the removed tote is returned to its assigned place in the stack.

Thus, there is a need for a container assembly which facilitates stacking of tote-type containers in such a manner as to permit removal and return of any tote in the stack without disturbing the other totes in the stack.

SUMMARY OF THE INVENTION

Accordingly, a primary object of the invention is to provide a container assembly that comprises a tote-type container and which is stackable with other container assemblies of the same configuration and which facilitates removal of tote-type containers from any location in a stack of such container assemblies without disturbing the remainder of stack.

Still another object is to provide a unique assembly of a tote and a slide-type holder for the tote, whereby the tote may be removed from the holder by a sliding action.

With the above and other objects in view, as will hereinafter appear, a feature of the present invention is the provision of a container assembly comprising (1) a tote holder or housing that has first and second opposite ends that are open and also an open top end, (2) a drawer member in the form of a tote movable into and out of the holder or housing through one of said first and second open ends, said drawer member having an open top end, and (3) a cover member adapted to make a releasable connection to said tote holder at said open top end of said tote holder. Optionally the cover member and the drawer member are configured so that the cover member may be used to cover the open top end of the drawer member when the latter is withdrawn from the tote holder.

The above and other features of the invention, including various novel details of construction and combinations of parts, will now be more particularly described with reference to the accompanying drawings. It will be understood that the particular embodiment herein disclosed is presented by way of illustration only and not as a limitation of the invention, and that the principles and features of this invention may be employed in various and numerous embodiments without departing from the scope of the invention.

DESCRIPTION OF THE PREFERRED EMBODIMENT

Figure 1:
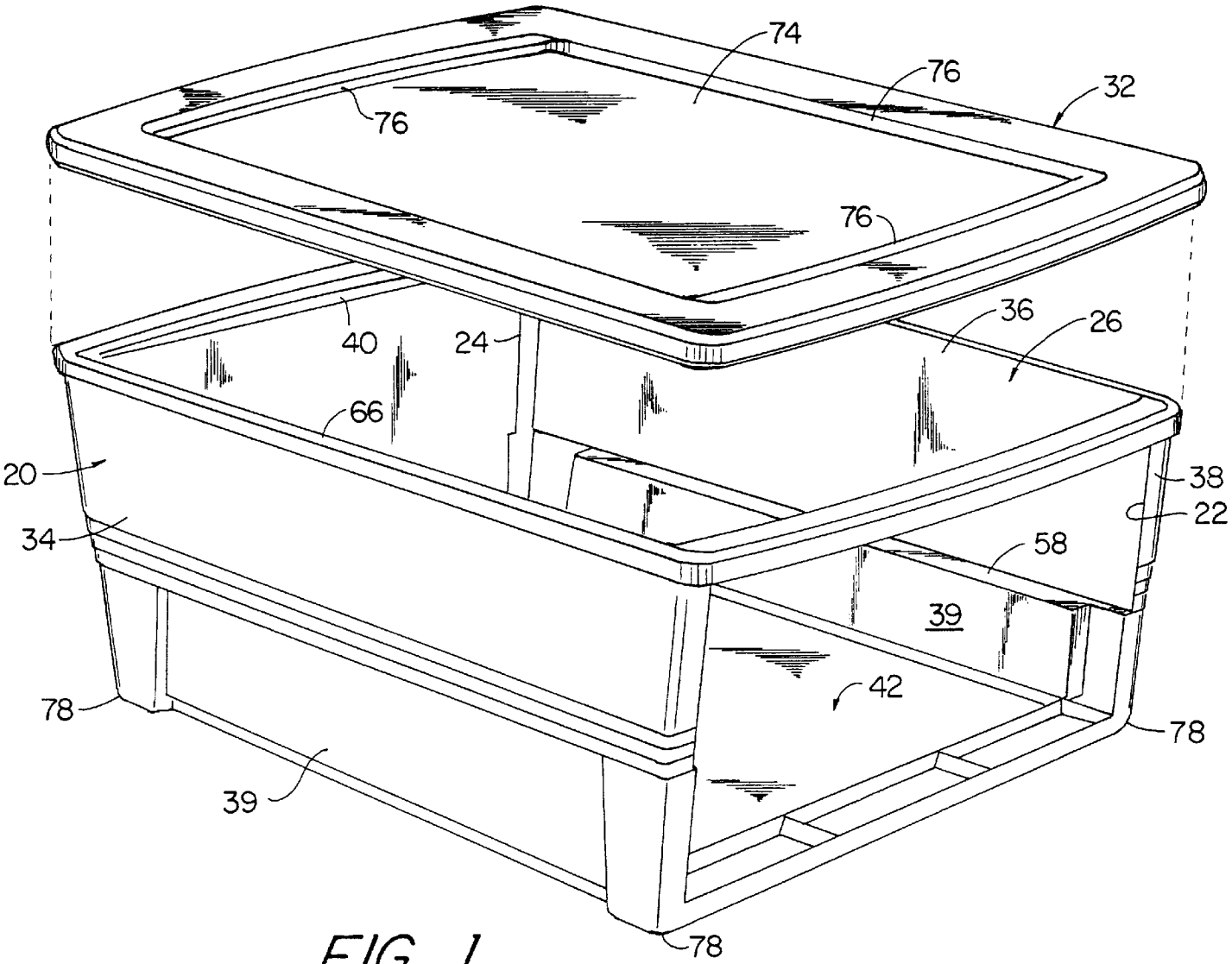
FIG. 1 is a perspective exploded view of one form of housing and cover illustrative of a portion of the invention.
Figure 2:
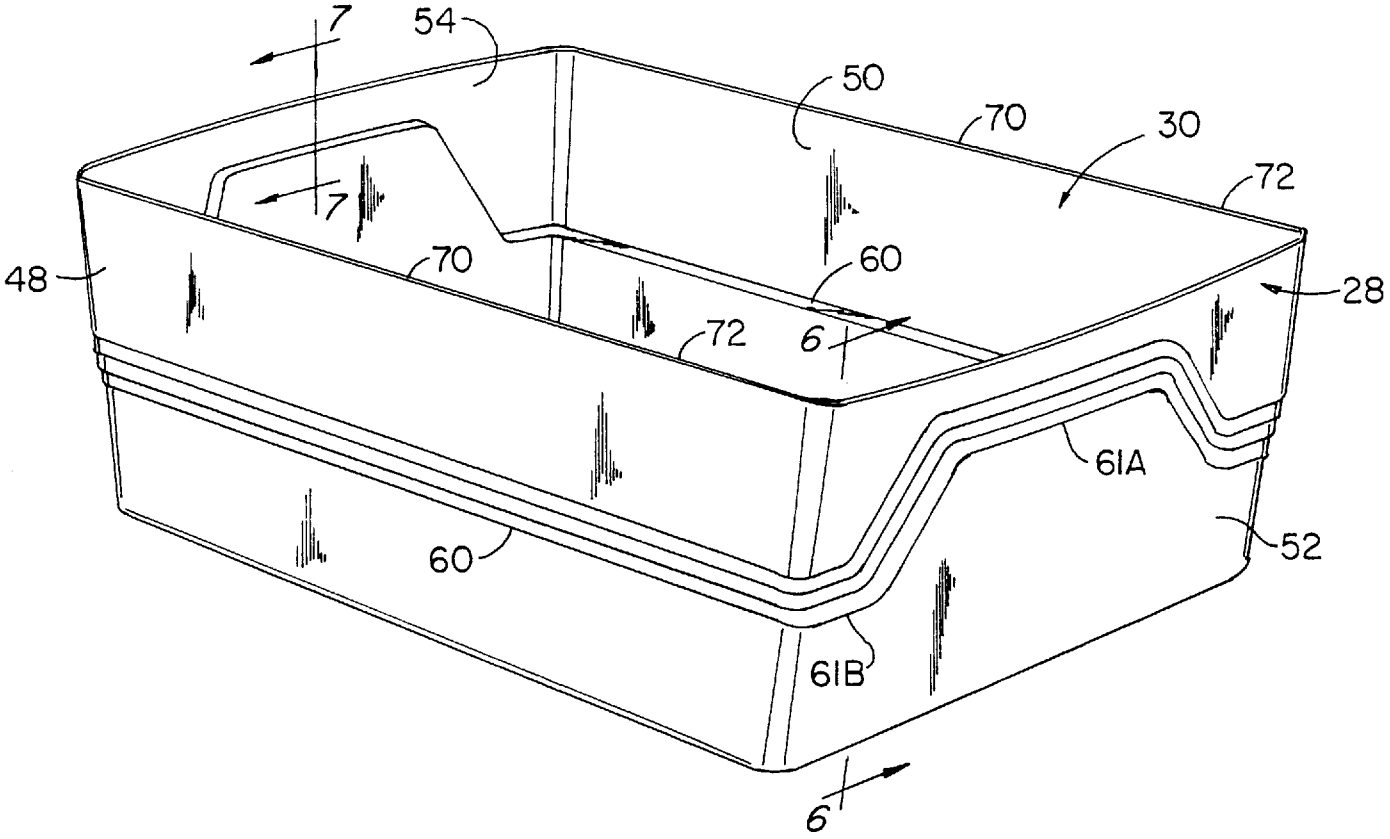
FIG. 2 is a perspective view of one form of drawer (tote) illustrative of another portion of the invention.

Referring to FIGS. 1 and 2, it will be seen that the illustrative assembly includes a housing 20 having opposed end openings 22, 24 and a top opening 26, and a drawer 28 in the form of a tote having an open top 30. The assembly further includes a cover 32 adapted to be attached to the housing 20 to close the open top 26 of the housing, as will be further explained hereinbelow. Housing 20, drawer 28 and cover 32 are injection molded of a suitable plastic, e.g., polyethylene, polypropylene or polyvinyl chloride.

Figure 3:
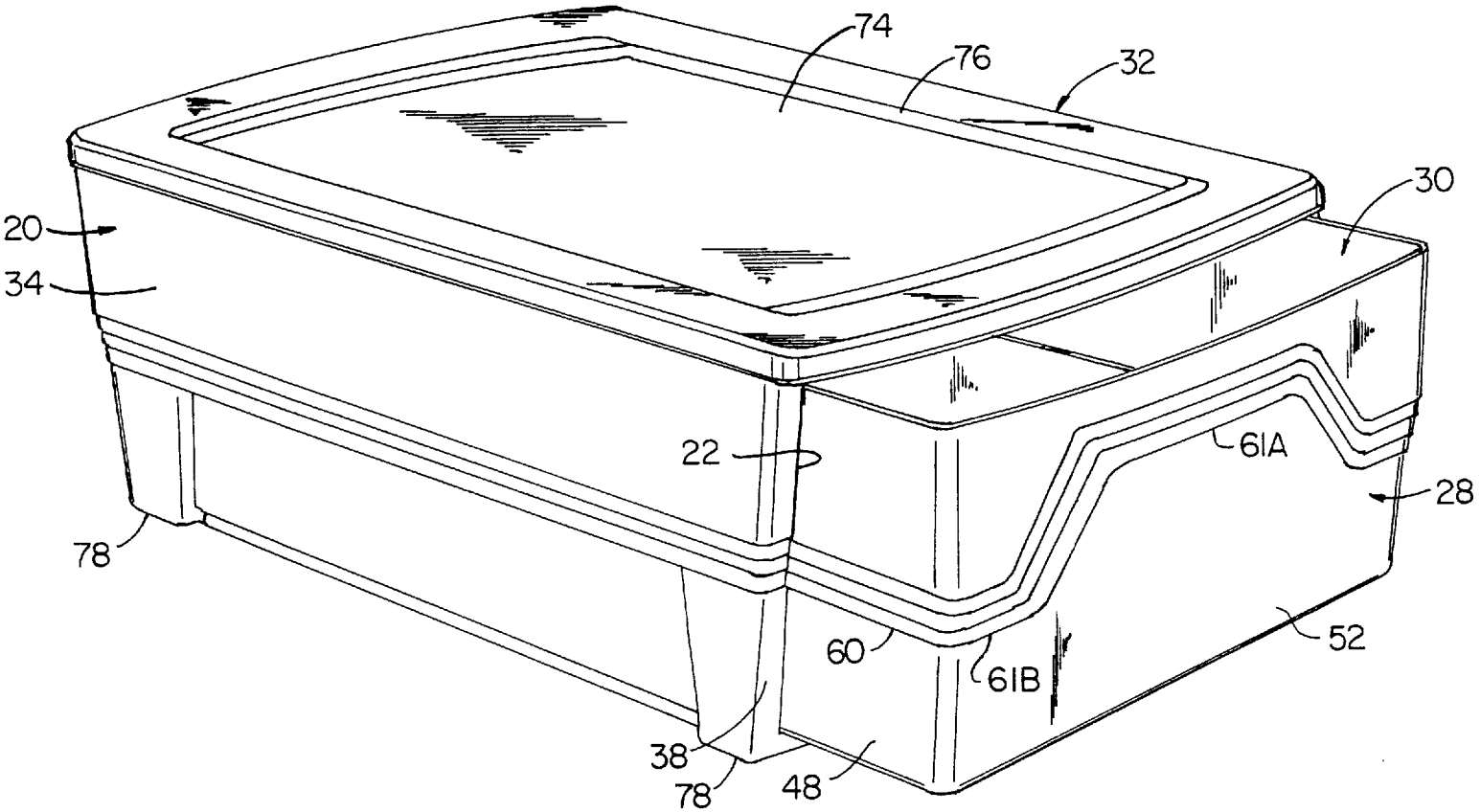
FIG. 3 is a perspective view of one form of container assembly comprising the housing of FIG. 1 and the drawer of FIG. 2, with the drawer in partially open position.

As is illustrated in FIG. 3, the tote or drawer 28 is movable into and out of the housing 20 through the housing open ends 22, 24. The drawer 28 may be pulled out of either of the housing's end openings 22, 24 so as to be completely removed from the housing, and may be substantially wholly disposed in the housing 20 (FIG. 4), similar to traditional drawers in cabinets, bureaus, desks, and the like.

The housing 20 (FIGS. 1 and 3–5) is provided with first and second opposed side walls 34, 36 and first and second opposed end walls 38, 40 interconnecting the side walls 34, 36. Openings 22 and 24 are formed in end walls 38 and 40. The side walls 34, 36 and end walls 38, 40 define the top opening 26 of the housing 20. The housing 20 is further provided with a bottom wall 42 which is contiguous with the side and end walls 34, 36, 38, 40.

The edges of the openings 22, 24 are proximate the side walls 34, 36, the bottom wall 42, and the open top 26, so that the openings 22, 24 occupy the majority of the area of their respective end walls 38, 40.

Referring to FIGS. 2–7, it will be seen that the drawer 28 includes first and second opposed side walls 48, 50 and first and second opposed end walls 52, 54 interconnecting the drawer side walls 48, 50. The drawer 28 is further provided with a bottom wall 56 contiguous with the drawer side and end walls 48, 50, 52, 54. The drawer side and end walls 48, 50, 52, 54 define the drawer open top 30.

Figure 5:
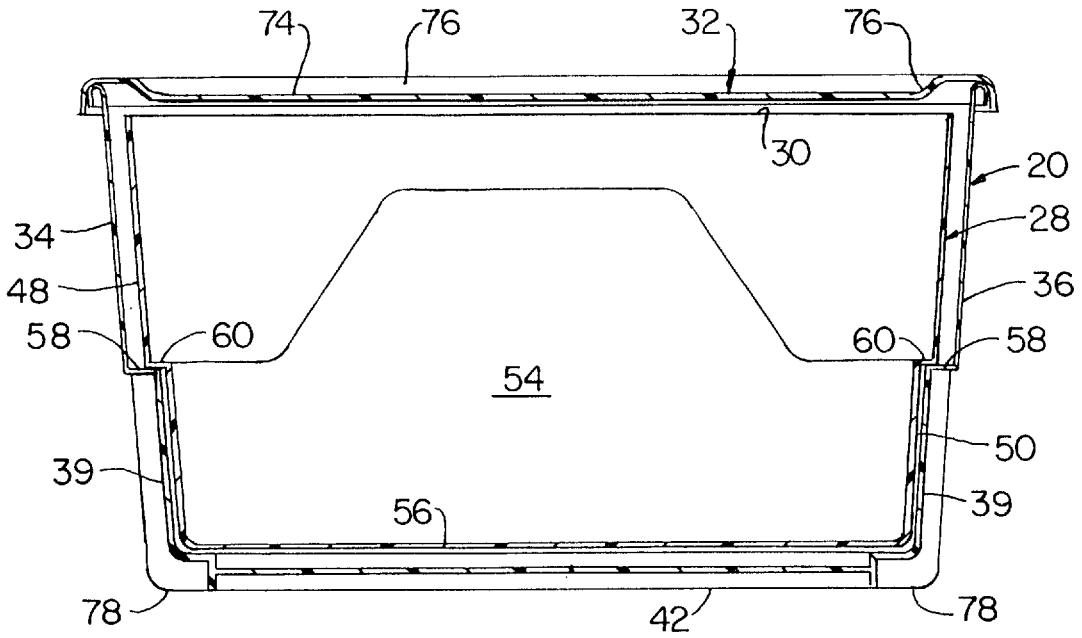
FIG. 5 is a cross-sectional view of the housing and drawer taken along line 5—5 of FIG. 4.

Referring particularly to FIG. 5, it will be seen that the housing side walls 34, 36 are indented as shown at 39 so as to form flat narrow shoulders 58 that extend lengthwise of the side walls between end openings 22 and 24. Preferably the shoulders extend throughout the majority of the length of the side walls. Shoulders 58 function as guide rails for supporting drawer 28 as hereinafter described. Similarly, each drawer side wall 58, 50 is molded with an outwardly-directed flat narrow flange 60 sized and configured complementary to the adjacent shoulder 58, so that flanges 60 can rest on and slide relative to shoulders 58, enabling the drawer 28 to slidably move in the housing 20.

Figure 6:
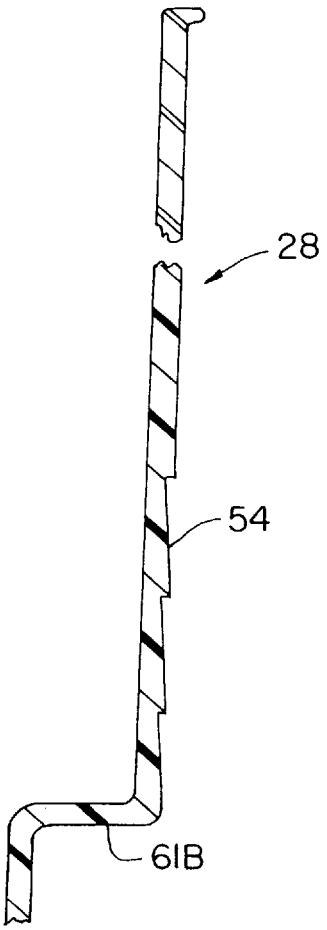
FIGS. 6 and 7 are enlarged cross-sectional views of the drawer taken along lines 6—6 and 7—7 of FIG. 2.
Figure 7:
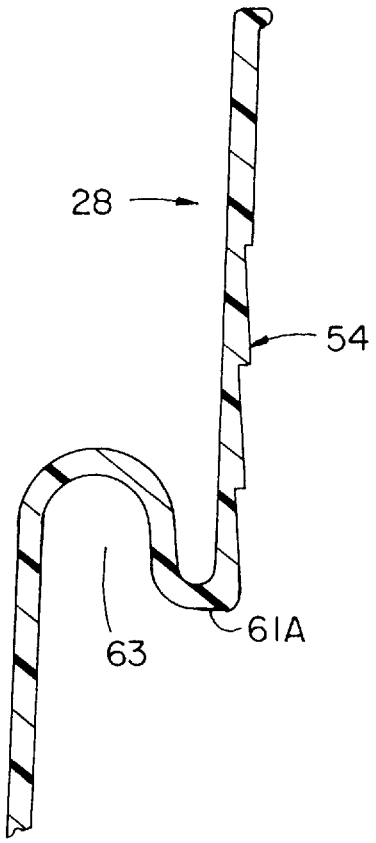

The end walls 52 and 54 of the tote also are molded with flanges 61(A,B) that preferably are contiguous with flanges 60. However, preferably flanges 61 are contoured so that central portions 61A thereof are offset from end portions 61B thereof so as to be closer to the upper edges of end walls 52 and 54. As seen in FIGS. 6 and 7, the end portions 61 B of flanges 61 are essentially flat like flanges 60, but the central portion 61A projects out further, i.e., is wider. and also is generally S-shaped in cross-section so as to provide a space 63 to accommodate a user's fingers, whereby the offset portions 61A function as handle portions that can be gripped to pull the drawer (tote) out from housing 20 and also to lift and carry the tote.

The side walls 34 and 36 are slanted slightly so that the spacing between them is greatest at their upper ends. Preferably also the end walls 38 and 40 are formed so as to have a similar converging relationship. The side and end walls of the tote drawer 28 are similarly slanted, with the drawer being sized so that its side walls lie close to the corresponding walls of the housing when the drawer is pointed within the housing.

Figure 8:
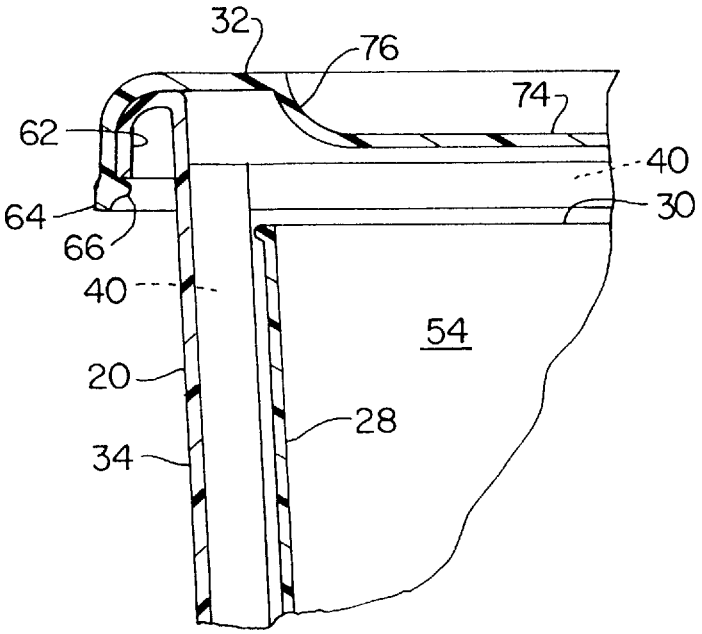
FIG. 8 is a fragmentary sectional view on an enlarged scale illustrative of the cooperative engagement of the housing and cover of FIG. 1.

FIGS. 1, 3 and 8 illustrate the manner in which the cover 32 is brought into engagement with the housing open top 26 to close the housing open top. As seen in FIGS. 1 and 8, the housing 20 is formed with a peripheral overhanging lip 62 that is formed integral with the upper ends of side walls 34, 36 and end walls 38, 40. The cover 32 is provided with a housing interlocking means in the form of a depending peripheral flange 64 having an internal rib 66. The latter extends for the full length of flange 64. The rib 66 is sized and located and lip 62 is sized and shaped so that when the cover is positioned on top of housing 20 the flange 64 will closely embrace lip 62 and rib 66 will engage the bottom edge surface of lip 62 so as to make a locking connection between the cover and the housing. Since the housing and cover are both made of a flexible plastic material like polyethylene, flange 64 is sufficiently resilient to yield outwardly away from lip 62 as rib 66 is forced down along the outer surface of the lip far enough to snap into position beneath the lip in the locking position shown in FIG. 8.

As shown in FIGS. 1, 3 and 8, the cover 32 is provided with a depression or recess 74 bordered by curved wall sections 76. Additionally, the bottom side of housing 20 is provided with rounded edges 78 which are configured complementary to the curved wall sections 76 of cover 32. Essentially the footprint of housing 20 is such that it will fit snugly within the cover recess 74 of another like assembly. As a consequence, one of the assemblies shown in FIGS. 3 and 4 can be positioned on top of and restrained against lateral movement relative to another like assembly, thereby making it possible to form a stable vertical stack of a plurality of such assemblies.

Figure 4:
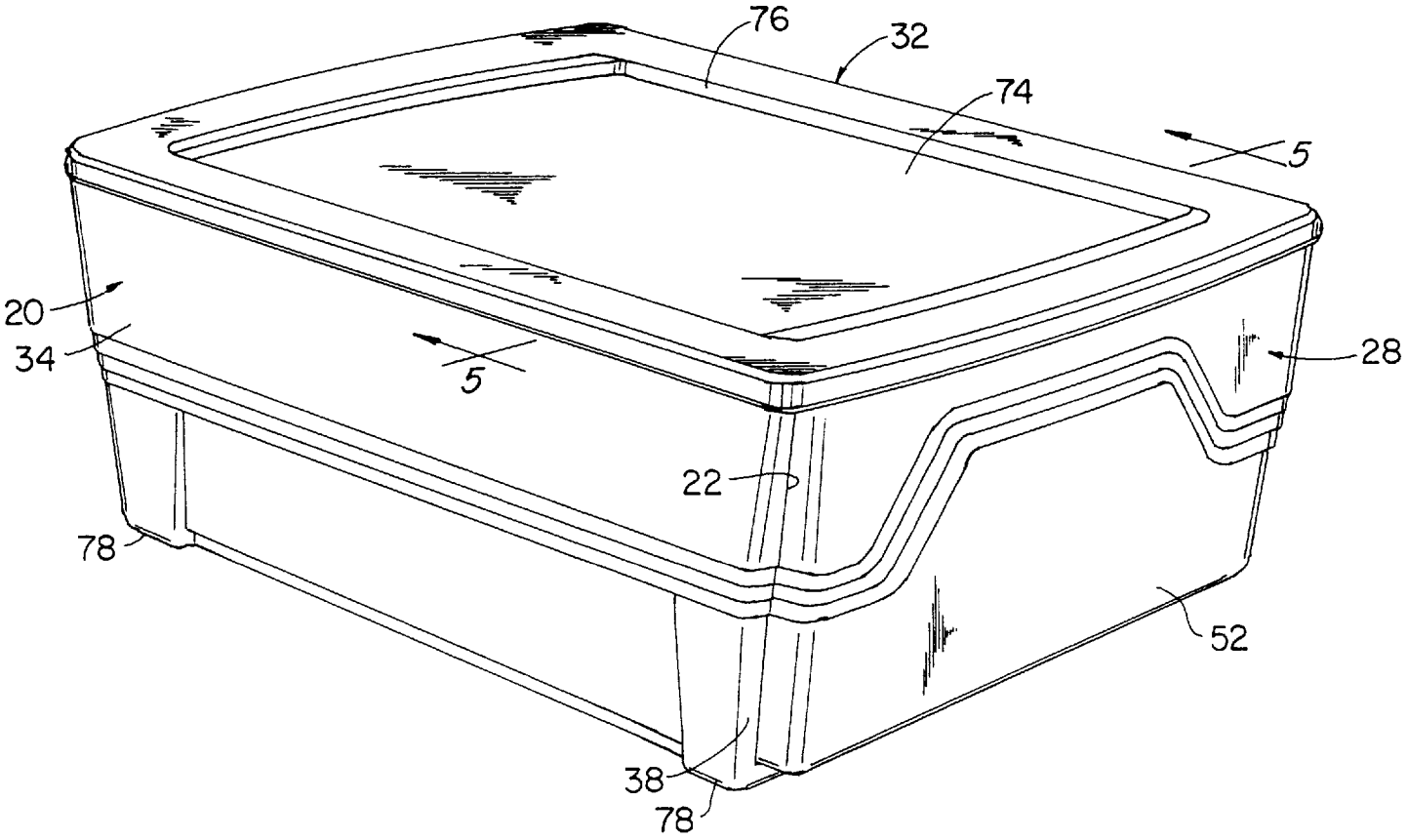
FIG. 4 is similar to FIG. 3 but with the drawer in a closed position.

In operation, a plurality of assemblies as shown in FIG. 4 may be stacked one on top of another (not shown). Any drawer 28 may be removed from its housing 20 by sliding the selected drawer out of either of the end wall openings 22, 24. If it is desired that the contents of the removed drawer be enclosed, the cover 32 from the top-most housing in the stack may be removed from the top-most housing and placed on the open top of the removed drawer. Alternatively, an extra cover may be used to cover a removed drawer, leaving the cover for the top-most assembly in place.

After use, the removed drawer may be reinserted into the housing from which it was removed. The cover 32 used to close off the used drawer, if taken from the top-most assembly, is replaced on the top-most assembly.

There is thus provided a container assembly which is readily stackable with other container assemblies of the same configuration and which facilitates removal of containers from any position in a stack of such containers, without disturbing the remainder of the containers in the stack.

Having a removable cover for housing 20 offers the advantage that it provides a way to remove contents from the tote or drawer without removing the tote or drawer from the housing. Moreover, although not shown, it is contemplated that the totes (drawers) and covers may be configured so that the cover makes a snap-fit connection with the drawers as well as with the housings, whereby the removed totes offer all of the advantages of conventional totes as well as providing the advantage of mating with the supporting housing as herein described.

It is to be understood that the present invention is by no means limited to the particular construction herein disclosed and/or shown in the drawings, but also comprises any modifications or equivalents within the scope of the claims.

What is claimed is:

1. A container assembly comprising:

a one-piece molded plastic housing having first and second opposed side walls, first and second opposed end walls formed integral with and interconnecting said side walls, and a bottom wall formed integral and contiguous with said side walls and said end walls, said side and end walls defining an open top for said housing, and said first and second end walls defining first and second end openings respectively;

a one-piece molded plastic drawer slidably movable into and out of said housing through said first and second end openings, said drawer having first and second opposed side walls, first and second opposed end walls formed integral with and interconnecting said first and second side walls, and a bottom wall formed integral and contiguous with said first and second side and end walls, said drawer side and end walls defining an open top for said drawer; and a plastic cover for closing off the open top of said housing; said housing having an overhanging peripheral lip formed at an upper end of each of its said opposed side walls and each of its said opposed end walls. and said plastic cover having a depending peripheral flange having a rib on its inner surface in position to engage said lip so as to make a releasable snap-type locking connection between said cover and said housing.

2. The assembly in accordance with claim 1 wherein each of said side walls of said housing is provided with an inwardly-directed shoulder that extends lengthwise of said each side wall, and each of said opposite side walls of said drawer is provided with an outwardly-directed flange engageable with and slidable on one of said shoulders.

3. The assembly in accordance with claim 1 wherein said cover is provided with a recess for receiving and supporting a like container assembly.

4. A container assembly comprising:

a one-piece molded plastic housing having first and second opposed side walls, first and second opposed end walls formed integral with and interconnecting said side walls, and a bottom wall formed integral and contiguous with said side walls and said end walls, said side and end walls defining an open top for said housing, and said first and second end walls defining mutually aligned first and second end openings respectively, and each of said side walls is contoured so as to form an inwardly directed shoulder that extends lengthwise of said each side wall;

a one-piece molded plastic drawer disposed within said housing, said drawer being sized and configured for movement into and out of said housing through said first and second end openings, said drawer having first and second opposed side walls, first and second opposed end walls formed integral with and interconnecting said first and second side walls, and a bottom wall formed integral and contiguous with said first and second side and end walls, said drawer side and end walls defining an open top for said drawer, each of said drawer side walls being contoured so as to form an outwardly directed flange that extends lengthwise of said drawer side wall, said outwardly directed flanges overlying and engaging said shoulders so that said drawer is slidably supported by said shoulders and can be moved into and out of said housing via said first and second end openings by a sliding movement; and a one piece molded plastic cover for closing off the open top of said housing, said cover and said housing being formed with cooperative locking means at their peripheries for releasably locking said cover to said housing in covering relation with said open top of said housing.

5. A container assembly according to claim 4 wherein said cooperative locking means comprises an overhanging peripheral lip formed at the upper end of each of said opposed side walls and each of said opposed end walls of said housing, and a depending peripheral flange on said cover, said peripheral flange having a rib on its inner surface in position to engage said lip so as to make a locking connection between said cover and said housing.

6. A container assembly according to claim 4 wherein said first and second opposed end walls of said drawer are contoured so as to form a handle on each of said end walls, whereby said drawer may be lifted and carried by a user.

7. A container assembly according to claim 6 wherein said drawer is contoured so that said handles are continuations of said outwardly directed flanges.

8. A container assembly according to claim 4 wherein said housing and said drawer have sloping side walls and sloping end walls, and said cover has a recess for receiving and supporting a superior like container assembly, whereby a plurality of said container assemblies may be stacked one upon the other.

* * * * *

UNITED STATES PATENT AND TRADEMARK OFFICE

CERTIFICATE OF CORRECTION

PATENT NO. : 5,816,674

DATED : October 6, 1998

INVENTOR(S) : Joseph D. Manos et al

It is certified that error appears in the above-identified patent and that said Letters Patent is hereby corrected as shown below:

Claim 8, column 6, line 20, change the numeral "4" to -- 7 --.

Signed and Sealed this

Twenty-ninth Day of December, 1998

*Attest:*

Bruce Lehman

BRUCE LEHMAN

*Attesting Officer*

*Commissioner of Patents and Trademarks*